US007823345B1

(12) United States Patent
Sorkin

(10) Patent No.: US 7,823,345 B1
(45) **Date of Patent: *Nov. 2, 2010**

(54) UNITARY SHEATHING WEDGE

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 330 days.

This patent is subject to a terminal disclaimer.

(21) Appl. No.: 11/950,295

(22) Filed: Dec. 4, 2007

Related U.S. Application Data

(63) Continuation-in-part of application No. 11/933,021, filed on Oct. 31, 2007, which is a continuation-in-part of application No. 11/933,041, filed on Oct. 31, 2007, which is a continuation-in-part of application No. 11/861,185, filed on Sep. 25, 2007.

(51) Int. Cl.
*E04C 5/08* (2006.01)

(52) U.S. Cl. ..... 52/223.13; 403/314; 403/367; 403/369; 403/374.1; 24/122.3

(58) Field of Classification Search ..... 52/223.13; 403/304, 314, 365, 367, 368, 369, 374.1; 24/122.6, 122.3, 459, 136 R, 115 M
See application file for complete search history.

(56) References Cited

U.S. PATENT DOCUMENTS

| | | | | | |
|---|---|---|---|---|---|
| 274,796 | A | * | 3/1883 | Loehner | 403/314 |
| 833,548 | A | * | 10/1906 | Putnam | 403/368 |
| 1,646,660 | A | * | 10/1927 | Prince | 439/805 |
| 2,166,458 | A | * | 7/1939 | Berndt et al. | 439/788 |
| 2,834,081 | A | * | 5/1958 | Stump, Jr. | 403/369 |
| 2,930,642 | A | * | 3/1960 | Howlett | 403/314 |
| 3,163,904 | A | * | 1/1965 | Ziolkowski | 403/365 |
| 3,253,332 | A | * | 5/1966 | Howlett et al. | 29/506 |
| 3,534,989 | A | * | 10/1970 | Yonkers | 403/369 |
| 3,596,330 | A | * | 8/1971 | Scott et al. | 24/122.3 |
| 3,698,749 | A | * | 10/1972 | Yonkers | 403/197 |
| 4,146,951 | A | * | 4/1979 | Howlett | 29/452 |
| 4,494,890 | A | * | 1/1985 | Lusk | 403/267 |
| 4,619,088 | A | * | 10/1986 | Ripoll Garcia-Mansilla | 52/223.13 |
| 4,623,277 | A | * | 11/1986 | Wayne et al. | 403/314 |
| 5,141,356 | A | * | 8/1992 | Chaize | 403/368 |
| 5,469,677 | A | * | 11/1995 | Luthi | 52/223.13 |
| 5,630,301 | A | * | 5/1997 | Sieg | 52/223.13 |
| 5,770,286 | A | | 6/1998 | Sorkin | |
| 5,839,235 | A | | 11/1998 | Sorkin | |
| 5,897,102 | A | * | 4/1999 | Sorkin | 254/29 A |
| 6,098,356 | A | | 8/2000 | Sorkin | |
| 6,381,912 | B1 | | 5/2002 | Sorkin | |
| 6,513,287 | B1 | | 2/2003 | Sorkin | |
| 6,631,596 | B1 | | 10/2003 | Sorkin | |
| 6,817,148 | B1 | | 11/2004 | Sorkin | |
| 2003/0159377 | A1 | * | 8/2003 | Marshall | 52/223.13 |
| 2004/0148881 | A1 | * | 8/2004 | Hayes | 52/223.13 |

* cited by examiner

*Primary Examiner*—Brian E Glessner
(74) *Attorney, Agent, or Firm*—Egbert Law Offices PLLC

(57) ABSTRACT

An apparatus for fixing the sheathing of an end of a tendon within an anchor body of a post-tension anchor system has an anchor body having a cavity formed in an interior thereof, a tendon extending into the cavity and having a sheathing extending at least partially thereover and having a sheathed portion and an unsheathed portion, a pair of wedges engaged with the unsheathed portion of the tendon in the cavity of the anchor body, and a wedge member engaged with the sheathing of the sheathed portion. The wedge member is a unitary piece having a longitudinal split extending from an end of the piece to an opposite end of the piece. The wedge member substantially encircles an interior or an exterior of the sheathing of the sheathed portion of the tendon.

7 Claims, 4 Drawing Sheets

UNITARY SHEATHING WEDGE

CROSS-REFERENCE TO RELATED APPLICATIONS

The present application is a continuation-in-part of U.S. application Ser. No. 11/933,041 filed on Oct. 31, 2007, entitled "Shrinkage Preventing Apparatus for the Sheathing of a Tendon", presently pending, and a continuation-in-part of U.S. application Ser. No. 11/933,029 filed on Oct. 31, 2007, entitled "Shrinkage Preventing Device for the Sheathing of a Tendon", now U.S. Pat. No. 7,797,895. U.S. application Ser. No. 11/933,041 is a continuation-in-part of U.S. application Ser. No. 11/861,185 filed on Sep. 25, 2007, entitled "Apparatus for Preventing Shrinkage of a Sheathing Over a Tendon", presently pending. U.S. application Ser. No. 11/933,029, now U.S. Pat. No. 7,797,895 is a continuation-in-part of U.S. application Ser. No. 11/861,185 filed on Sep. 25, 2007, entitled "Apparatus for Preventing Shrinkage of a Sheathing Over a Tendon", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post tension anchor systems. More particularly, the present invention relates to dead-end anchors used in such post-tension systems. More particularly, the present invention the present invention relates to devices and apparatuses used to prevent shrinkage of a sheathing that extends over the tendon.

2. Description of Related Art Including Information Disclosed Under 37 CFR 1.97 and 37 CFR 1.98

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the tendon. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead end anchorage, the end of the sheathing will tend to shrink slowly away from the dead end anchorage.

The problem that affects many anchorage system is the inability to effectively prevent liquid intrusion into this area of the unsheathed portion where sheathing shrinkage has occurred. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the of the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. Each of this technology suggests the placement of an additional tube over the polymeric encapsulation and additional materials for sealing the unsheathed portion of the tendon which extends outwardly of the anchor. In certain circumstances, these tubes are sometimes improperly installed and, at best, are simply an additional component that needs to be associated with the post-tension system. As such, it adds additional costs and can require additional labor associated with the installation of the sealing tube. As such, a need has developed so as to avoid the use of such a tube with the dead-end anchor of a post-tension anchor system.

The present inventor has several pending applications addressing the need of avoiding the use of a tube to counter shrinkage of the sheathing of a tendon. For example, U.S. patent application Ser. No. 11/933,029 filed on Oct. 31, 2007, describes a shrinkage-preventing device for the sheathing of a tendon. The device has an anchor body having a cavity formed in an interior thereof, a tendon extending into the cavity having a sheathing extending at least partially thereover and having a sheathed portion and an unsheathed portion, a pair of wedges engaged with the unsheathed portion of the tendon in the cavity of the anchor body, and at least one wedge member engaged with the sheathed portion. The wedge member has a wide end and a narrow end, the wide end being adjacent to the pair of wedges. The wedge member has a decreasing thickness from the wide end to the narrow end.

U.S. patent application Ser. No. 11/933,041 filed on Oct. 31, 2007, describes a shrinkage-preventing apparatus for the sheathing of a tendon. The apparatus has an anchor body that has a cavity formed in an interior thereof, a tendon extending into the cavity that has a sheathing extending at least partially thereover and has a sheathed portion and an unsheathed portion, a pair of wedges engaged with the unsheathed portion of the tendon in the cavity of the anchor body, and at least one wedge member engaged with the sheathed portion. The wedge member has a first portion and a second portion. The first portion is of a constant thickness and has an end adjacent the pair of wedges. The second portion has a first end and a second end, the second portion being of a decreasing thickness from the first end to the second end.

It is an object of the present invention to provide an apparatus which effectively prevents shrinkage of the sheathing at the dead-end anchor of a post-tension anchor system.

It is another object of the present invention to provide an apparatus that can be easily installed during the installation of the wedges associated with the dead-end anchorage of a post-tension anchor system.

It is a further object of the present invention to provide an apparatus which effectively engages the sheathing at the dead-end anchorage so as to resist shrinkage forces associated with the sheathing.

It is still another object of the present invention to provide an apparatus which resists the shrinkage of the sheathing of a tendon of a post-tension anchor system which is easy to install, relatively inexpensive and easy to manufacture.

These and other objects and advantages of the present invention will become apparent from a reading of the attached specification and appended claims.

BRIEF SUMMARY OF THE INVENTION

The present invention is an apparatus for preventing the shrinkage of a sheathing at the dead-end anchorage of a post-tension anchor system. This apparatus includes an anchor body that has a cavity formed in an interior thereof, a tendon extending into the cavity that has a sheathing extending at least partially thereover and has a sheathed portion and an unsheathed portion, a pair of wedges engaged with the unsheathed portion of the tendon in the cavity of the anchor body, and a wedge member engaged with the sheathing of the sheathed portion.

The wedge member is a unitary piece having a longitudinal split extending from an end of the piece to an opposite end of the piece. The wedge member substantially encircles the sheathing of the sheathed portion of the tendon.

In one embodiment, the wedge member has a first portion and a second portion. The first portion is of a generally constant thickness and has an end adjacent the pair of wedges. The second portion has a first end and a second end and is of a decreasing thickness from the first end to the second end. The wedge member has an interior surface and an exterior surface. The interior surface is in compressive contact with the tendon, and the exterior surface is engaged with the sheathing of the sheathed portion. The exterior surface of the wedge member has a biting means for frictionally engaging an inner surface of the sheathing of the sheathed portion. The interior surface of the first portion is in generally parallel relation to the exterior surface thereof.

In an alternative embodiment, the wedge member has a wide end and a narrow end. The wide end is adjacent to the pair of wedges. The wedge member is of a decreasing thickness from the wide end to the narrow end. The wedge member has an interior surface and an exterior surface. The interior surface is in compressive contact with the sheathing of the sheathed portion, and the exterior surface is in compressive contact with a wall of the cavity. The interior surface of the wedge member extends in generally parallel relation to the tendon. The exterior surface of the wedge member extends at an acute angle with relation to the interior surface.

The engagement of the wedge member with the sheathing of the sheathed portion is suitable for retaining the sheathing against up to 150 pounds of pulling force. The sheathed portion extends into the cavity of the anchor body, and the wedge member is positioned in the cavity. The wedge member has a generally circular cross-section.

The cavity of the anchor body has a tapered portion so as to have wide end opening at one end of the anchor body and a narrow end interior of the anchor body. The cavity has a passageway extending from the narrow end so as to open at an opposite end of the anchor body. The wedge member is positioned in the passageway, and the pair of wedges extend along the tapered portion of the cavity.

The anchor body has a polymeric encapsulation extending thereover. The polymeric encapsulation defines a trumpet extending outwardly of the anchor body in axial alignment with the cavity. The trumpet has a seal extending around an interior thereof so as to be in liquid-tight sealing relation with the sheathed portion of the tendon.

DETAILED DESCRIPTION OF THE INVENTION

Figure 1:
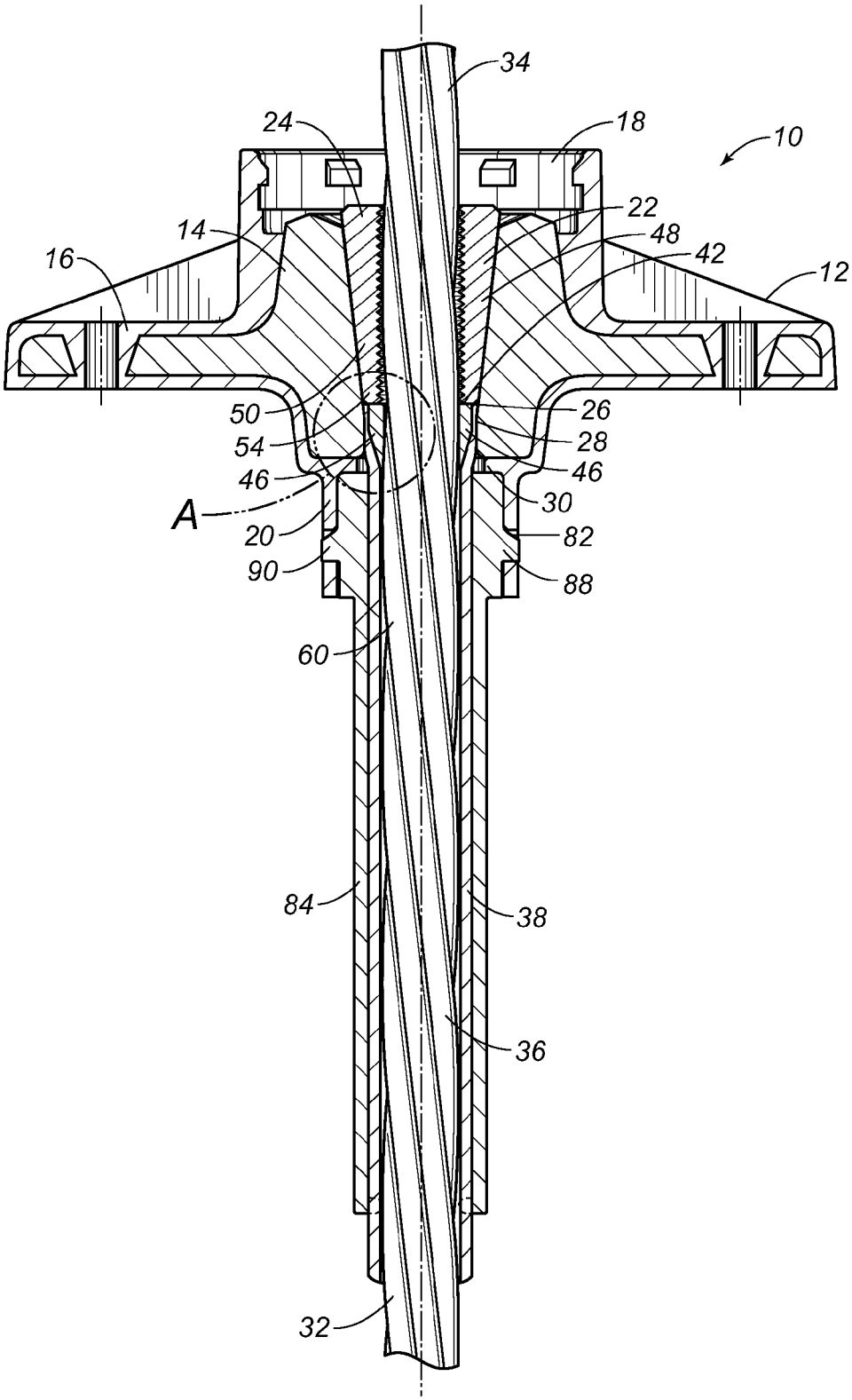
FIG. 1 is a cross-sectional view of the apparatus of the present invention.

Referring to FIG. 1, there is shown the apparatus 10 of the preferred embodiment of the present invention. In particular, the apparatus 10 shows the dead-end anchorage 12. The dead-end anchorage 12 includes an anchor body 14 with a polymeric encapsulation 16 extending thereover and therearound. A cap-receiving opening 18 is formed at one end of the polymeric encapsulation 16. A trumpet 20 is formed at the opposite end of the polymeric encapsulation 16. The trumpet 20 is a tubular section that extends outwardly of the end of the dead-end anchorage 12 for a short distance. The anchor body 14 is a steel anchor. The anchor body 14 has a cavity 22 formed in an interior thereof. The cavity 22 has tapered walls having a wide end 24 and a narrow end 26. The wide end 24 opens at an end of the anchor body 14. The narrow end 26 opens on the interior of the cavity 22. A passageway 28 extends from the narrow end 26 of cavity 22 to the opposite end 30 of the anchor body 14.

A tendon 32 extends entirely through the cavity 22 of the anchor body 14. The tendon 32 also extends through the trumpet 20 of the polymeric encapsulation 16. The tendon 32 has an unsheathed portion 34 and a sheathed portion 36. Sheathing 38 extends over the tendon 32. Typically, a lubricant will be applied between the exterior surface of the tendon 32 and the inner surface 60 of the sheathing 38.

The trumpet 20 includes a notch 82 extending around an interior thereof. The notch 82 receives a lip 90 of the connection portion 88 of a corrosion protection tube 84, which is in liquid-tight engagement with a surface of the sheathing 38. As such, the tube 84 effectively prevents liquid intrusion into the interior cavity 22 of the anchor body 14.

Referring still to FIG. 1, wedge member 46 is positioned in the passageway 28 of cavity 22. The wedge member 46 serves to engage with the end 42 of the sheathing 38 so as to strongly adhere the end 42 of the sheathing 38 within the passageway 28. Wedge member 46 generally abuts the ends 54 of wedges 48 and 50, respectively, extending within the cavity 22.

Figure 2:
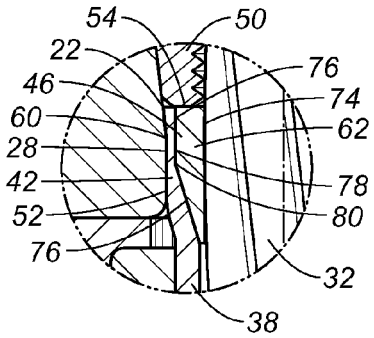
FIG. 2 is an enlarged cross-sectional view of the circled portion in FIG. 1, showing the relationship between the wedge member and the sheathing of the tendon.

FIG. 2 shows an enlarged cross-sectional view of the circled portion A in FIG. 1. As can be seen in FIG. 2, wedge member 46 is interposed between the inner surface 60 of the end 42 of the sheathing 38 and the exterior surface of the tendon 32. Wedge member 46 is urged into place by the action of the wedge 50 during installation. Wedge member 46 generally abuts the end 54 of wedge 50 extending within the cavity 22.

Figure 3:
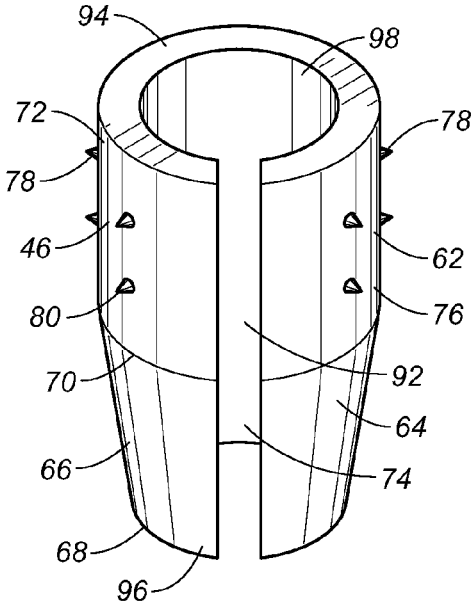
FIG. 3 is a perspective view of the wedge member of the preferred embodiment.

Referring to FIG. 3, there is shown a perspective view of the wedge member 46. The wedge member 46 of the preferred embodiment has a first portion 62 and a second portion 64. The first portion 62 has an end 70 and an opposite end 72. The second portion 64 has a first end 66 and a second end 68. The first end 66 of the second portion 64 abuts the end 70 of the first portion 62. The first portion 62 is of a constant thickness from end 70 to opposite end 72. The second portion 64 is of a constantly decreasing thickness from first end 66 to second end 68. The exterior surface 76 of the wedge member 46 extends along both the first and second portions 62 and 64. Likewise, the interior surface 74 of the wedge member 46 extends along both the first and second portions 62 and 64. The exterior surface 76 of the first portion 62 is generally parallel in relation to the interior surface 74 thereof. The exterior surface 76 of the first portion 62 has a biting means 78. In the preferred embodiment of the present invention, the biting means 78 are equally spaced teeth 80 that are triangular in shape.

Especially noticeable in FIG. 3 is that the wedge member 46 is a unitary wedge member with a longitudinal split 92 extending from the end 94 of the wedge member 46 to the opposite end 96 thereof. This split 92 allows the wedge member 46 to be slipped over the sheathing 38 of the sheathed portion 36 of the tendon 32. As can be seen in FIG. 3, the wedge member 46 is formed so that it substantially encircles the sheathing of any tendon inserted into the interior 98 thereof. In fact, the only part of the wedge member 46 not encircling the sheathing of a tendon is the split 92. The wedge member 46 is circular in shape so as to accommodate the shape of the sheathing of a tendon. The diameter of the interior 98 of the wedge member 46 is generally constant from end 94 to the opposite end 96.

Figure 4:
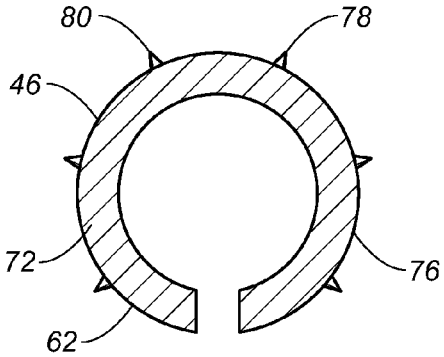
FIG. 4 is a cross-sectional view of the wide end of the wedge member of the preferred embodiment.

In FIG. 4 there is shown a cross-sectional view of the wide end 94 of the wedge member 46 of the preferred embodiment of the present invention. As can be seen the wedge member 46 has a generally circular cross-section. The teeth 80 of the biting means 78 extend outwardly from the exterior surface 76 of the wedge members 44 and 46. The circular shape of the wedge member 46 optimizes the contact surface between the exterior surface 76 of the wedge member 46 and the sheathing 38 so as to fix the sheathing 38 and keep it from shrinking.

Figure 5:
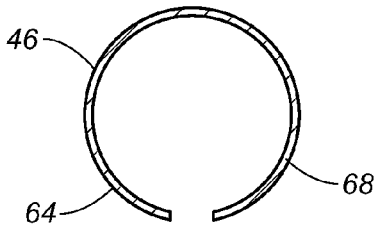
FIG. 5 is a cross-sectional view of the narrow end of the wedge member of the preferred embodiment.

In FIG. 5 there is shown a cross-sectional view of the narrow end 96 of the wedge member 46 of the preferred embodiment of the present invention. As can be seen, the narrow end 96 has a generally circular cross-section. Comparing FIGS. 4 and 5, it can be seen that the opposite end 72 of the first portion 62 is of a thickness greater than the second end 68 of the second portion 64. That is, the thickness of the wide end 94 is greater than the thickness of the narrow end 96.

Referring back to FIG. 2, the wedge member 46 exerts a compressive force on the inner surface 60 of the end 42 of the sheathing 38 which causes the end 42 of the sheathing 38 to be rigidly retained in compressive relationship between the exterior surface 76 of wedge member 46 and the inner wall 52 of the passageway 28. The biting means 78 of the wedge member 46 exerts a frictional force on the inner surface 60 of the end 42 of the sheathing 38 which causes the end 42 of the sheathing 38 to be rigidly retained in frictional relationship between the teeth 80 of the biting means 78 of the exterior surface 76 of the first portion 62 of the wedge member 46 and the inner wall 52 of the passageway 28. As such, the end 42 of the sheathing 38 is fixedly retained within the passageway 28 of the cavity 22. Because of this fixed retention, any shrinkage effects are avoided at the dead-end anchorage 12 of apparatus 10.

This compressive and frictional engagement is extremely effective in preventing the shrinkage of the sheathing 38. Typically, the force of shrinkage is between 100 and 150 pounds of pulling force. On the other hand, the force of the wedge member 46, as installed, will resist 30,000 pounds of force applied to the tendon 32. As such, although the engagement of the end 42 of sheathing 38 with the wall 52 the passageway 28 would appear to be rather weak, the forces are actually very strong as compared to those that are required in order to keep the sheathing 38 from shrinking.

The wedge member 46 of the present invention is specially designed to have maximum compressive force where the narrow end 26 of the cavity 22 meets the passageway 28 of the cavity 22. The strong compressive forces coupled with the frictional force created by the biting means 78 of the wedge members 46 all act to retain the end 42 of the sheathing 38 within the anchor body 14. In this way, the end 42 of the sheathing 38 is guaranteed not to shrink from the anchor body 14.

The wedge member 46 fits generally inside the sheathing 38 around the perimeter of the tendon 32 so as to form a continuous engaging retaining relationship between the inner surface 60 of the sheathing 38 and the exterior surface 76 of the wedge member 46 and a continuous compressive relationship between sheathing 38 and the wall 52 of the passageway 28. Additionally, because of this encircling relationship of the wedge member 46 and the strong compressive-fit relationship between the end 42 of the sheathing 38 and the inner wall 52 of the passageway 28, liquid intrusion into the cavity is effectively prevented. This relationship serves as a further "secondary" seal so as to prevent liquid intrusion.

Figure 6:
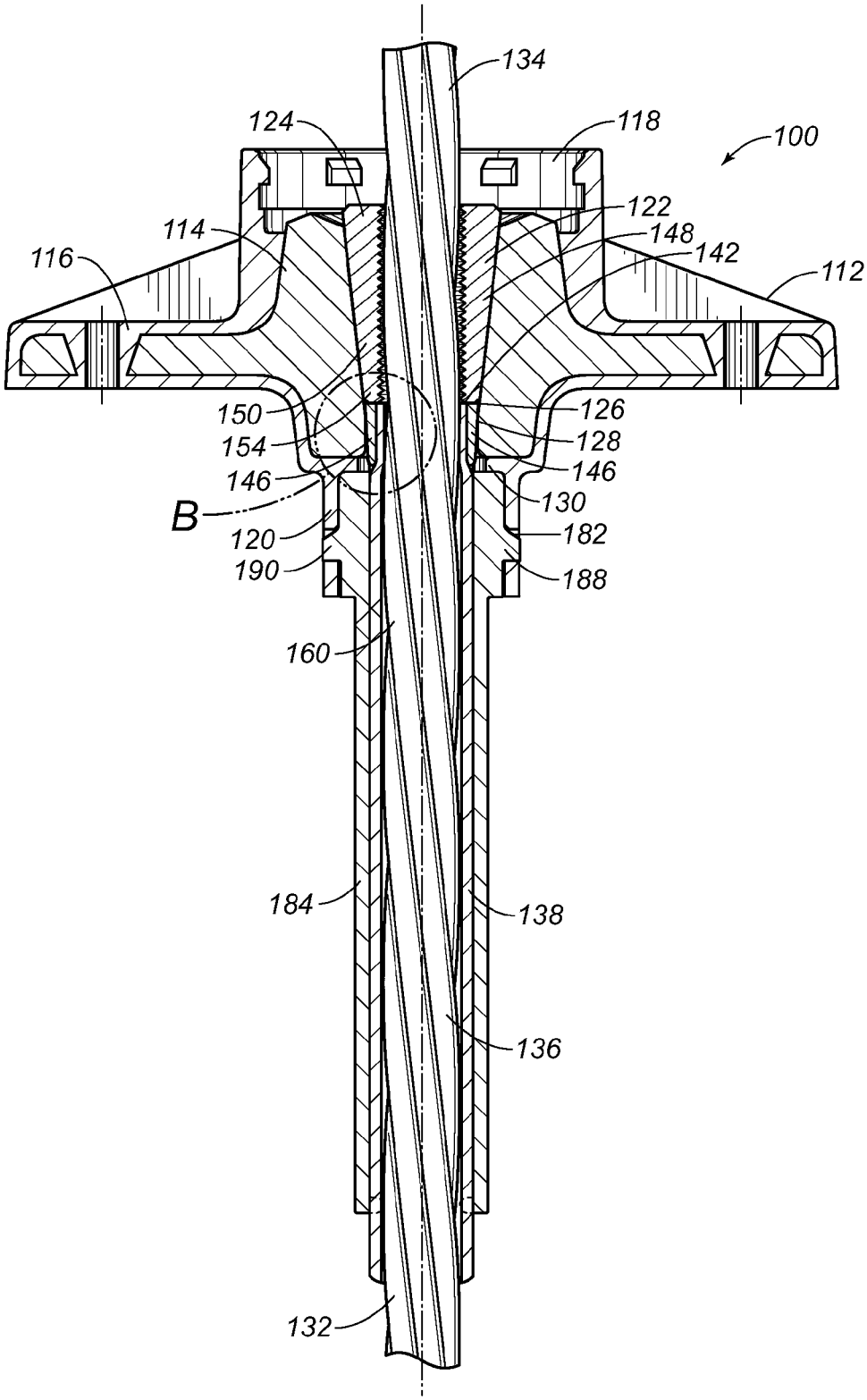
FIG. 6 is a cross-sectional view of an alternative embodiment of the apparatus of the present invention.

Referring to FIG. 6, there is shown the apparatus 100 of an alternative embodiment of the present invention. In particular, the apparatus 100 shows the dead-end anchorage 112. The dead-end anchorage 112 includes an anchor body 114 with a polymeric encapsulation 116 extending thereover and thereafter. A cap-receiving opening 118 is formed at one end of the polymeric encapsulation 116. A trumpet 120 is formed at the opposite end of the polymeric encapsulation 116. The trumpet 120 is a tubular section that extends outwardly of the end of the dead-end anchorage 112 for a short distance. The anchor body 114 is a steel anchor. The anchor body 114 has a cavity 122 formed in an interior thereof. The cavity 122 has tapered walls having a wide end 124 and a narrow end 126. The wide end 124 opens at an end of the anchor body 114. The narrow end 126 opens on the interior of the cavity 122. A passageway 128 extends from the narrow end 126 of cavity 122 to the opposite end 130 of the anchor body 114.

A tendon 132 extends entirely through the cavity 122 of the anchor body 114. The tendon 132 also extends through the trumpet 120 of the polymeric encapsulation 116. The tendon 132 has an unsheathed portion 134 and a sheathed portion 136. Sheathing 138 extends over the tendon 132. Typically, a lubricant will be applied between the exterior surface of the tendon 132 and the inner surface 160 of the sheathing 138.

The trumpet 120 includes a notch 182 extending around an interior thereof. The notch 182 receives a lip 190 of the connection portion 188 of a corrosion protection tube 184, which is in liquid-tight engagement with a surface of the sheathing 138. As such, the tube 184 effectively prevents liquid intrusion into the interior cavity 122 of the anchor body 114.

Referring still to FIG. 6, wedge member 146 is positioned in the passageway 28 of cavity 22. The wedge member 146 serves to engage with the end 142 of the sheathing 138 so as to strongly adhere the end 142 of the sheathing 138 within the passageway 128. Wedge member 146 generally abuts the ends 154 of wedges 148 and 150, respectively, extending within the cavity 122.

Figure 7:
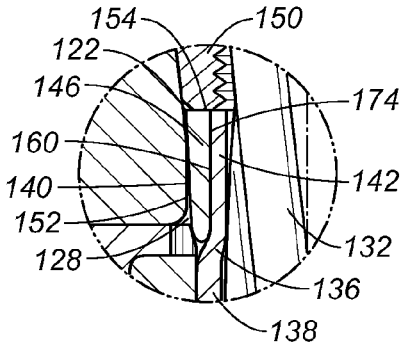
FIG. 7 is an enlarged cross-sectional view of the circled portion in FIG. 5, showing the relationship between the wedge member and the sheathing of the tendon.

FIG. 7 shows an enlarged cross-sectional view of the circled portion B in FIG. 6. As can be seen in FIG. 7, wedge member 146 is interposed between the outer surface 160 of the end 142 of the sheathing 138 and the wall 140 of the cavity 122. Wedge member 146 is urged into place by the action of the wedge 150 during installation. Wedge member 146 generally abuts the end 154 of wedge 150 extending within the cavity 122. The wedge member 146 exerts a compressive force on the outer surface 160 of the end 142 of the sheathing 138 which causes the end 142 of the sheathing 138 to be rigidly retained in compressive relationship between the interior surface 174 of the wedge member 146 and the surface of the tendon 132. As such, the end 142 of the sheathing 138 is fixedly retained within the passageway 128 of the cavity 122. Because of this fixed retention, any shrinkage effects are avoided at the dead-end anchorage 112 of device 110. Also noticeable is the sheathed portion 136 that is fixed between interior surface 174 of the wedge member 146 and the tendon 132 has a thickness less than the thickness of the remaining sheathed portion 136 that is not fixed in place. As can also be seen, the wedge member 146 has an inner diameter greater than the outer diameter of the sheathing 138.

This compressive contact is extremely effective in preventing the shrinkage of the sheathing 138. Typically, the force of shrinkage is between 100 and 150 pounds of pulling force. On the other hand, the wedge member 146, as installed, will resist 30,000 pounds of force applied to the tendon 132. As such, although the engagement of the end 142 of sheathing 138 with the wall 152 the passageway 128 would appear to be rather weak, the forces are actually very strong as compared to those that are required in order to keep the sheathing 138 from shrinking.

Figure 8:
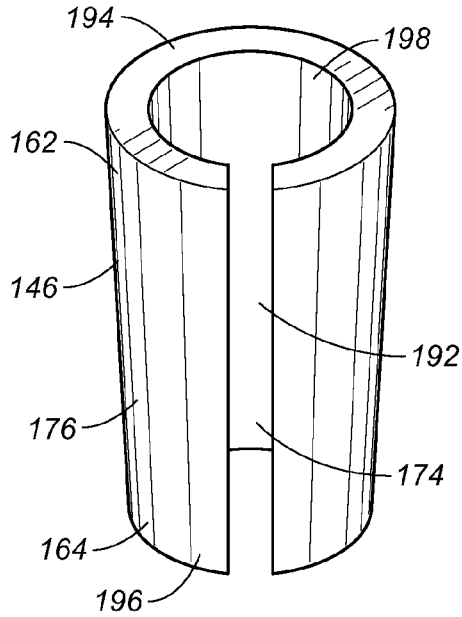
FIG. 8 is a perspective view of the wedge member of the alternative embodiment of the present invention.

FIG. 8 shows a perspective view of the wedge member 146 of the alternative embodiment. As can be seen, the wedge member 146 is a unitary wedge member having a wide end 162 and a narrow end 164. The wedge member 146 has an exterior surface 176 and an interior surface 174. The interior surface 174 of the wedge member 146 is generally parallel to the tendon 132. The exterior surface 176 of the wedge member 146 is at an acute angle in relation to interior surface 174. As can be seen, wedge member 146 of the preferred embodiment has a constantly decreasing thickness from wide end 162 to narrow end 164. It is also contemplated that the thickness decreases is other ways, such as an arcuate decrease in thickness from the wide end 162 to the narrow end 164.

Especially noticeable in FIG. 8 is that the wedge member 146 is a unitary piece with a longitudinal split 192 extending from the end 194 of the wedge member 146 to the opposite end 196 thereof. This split 192 allows the wedge member 146 to be slipped over the sheathing of the sheathed portion of a tendon (not shown). As can be seen in FIG. 8, the wedge member 146 is formed so that it substantially encircles the sheathing of any tendon inserted into the interior 198 thereof. In fact, the only part of the wedge member 146 not encircling the sheathing of a tendon is the split 192. The wedge member 146 is circular in shape so as to accommodate the shape of the sheathing of a tendon. The diameter of the interior 198 of the wedge member 146 is generally constant from end 194 to the opposite end 196.

Figure 9:
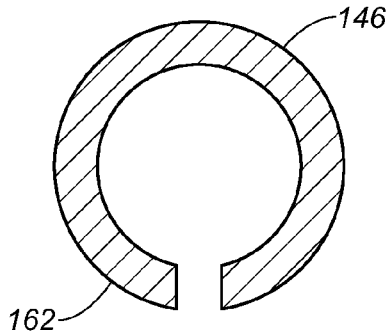
FIG. 9 is a cross-sectional view of the wide end of the wedge member of the alternative embodiment.

FIG. 9 shows a cross-sectional view of the wide end 162 of the wedge member 146 of the alternative embodiment. As can be seen, the wedge member 146 has a generally circular cross-section. The tendon with its sheathing (not shown) extends within the wedge member 146. The circular shape of the wedge member 146 optimizes the contact surface between the wedge member 146 and the sheathing 138 so as to fix the sheathing 138 and keep it from shrinking.

Figure 10:
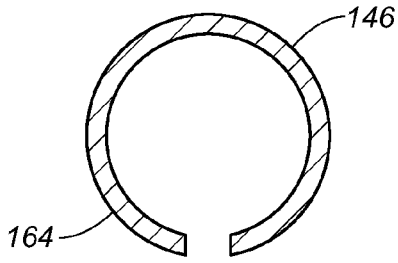
FIG. 10 is a cross-sectional view of the narrow end of the wedge member of the alternative embodiment.

FIG. 10 shows a cross-sectional view of the narrow end 164 of the wedge member 146 of the alternative embodiment. As can be seen, the wedge member 146 has a generally circular cross-section. Comparing FIGS. 9 and 10, the wide end 162 has a thickness greater than the a thickness of the narrow end 164. As can be appreciated, the inner diameters of the wide end 162 and the narrow end 164 are the same so as to effectively accommodate the sheathing of a tendon.

The wedge member 146 of the alternative embodiment is specially designed to have maximum compressive force where the narrow end 126 of the cavity 122 meets the passageway 128 of the cavity 122. In this way, the end 142 of the sheathing 138 is guaranteed not to shrink from the anchor body 114.

The wedge member 146 extends generally around the perimeter of the sheathing 138 so as to form a continuous compressive retaining relationship between the interior surface 174 of the wedge member 146 and the outer surface 160 of the sheathing 138 and a compressive retaining relationship between the exterior surface 176 of the wedge member 146 and the wall 152 of the passageway 128. Additionally, because of this encircling relationship of the wedge member 146 and the strong compressive-fit relationship between the end 142 of the sheathing 138 and the tendon 132, liquid intrusion into the cavity is effectively prevented. This relationship serves as a further "secondary" seal so as to prevent liquid intrusion.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

an anchor body having a cavity formed in an interior thereof;

a tendon extending into said cavity, said tendon having a sheathing extending at least partially thereover, said tendon having a sheathed portion and an unsheathed portion;

a pair of wedges engaged with said unsheathed portion of said tendon in said cavity of said anchor body; and a unitary wedge member engaged with said sheathing of said sheathed portion, said wedge member having a longitudinal split extending from one end of said wedge member to an opposite end of said wedge member, said wedge member having an exterior surface, said exterior surface of said wedge member having a biting means for biting into an inner surface of said sheathing of said sheathed portion, said cavity of said anchor body having a tapered portion so as to have wide end opening at one end of said anchor body and a narrow end interior of said anchor body, said cavity having a passageway extending from said narrow end so as to open at an opposite end of said anchor body, said wedge member positioned in said passageway, said pair of wedges extending along said tapered portion of said cavity, said anchor body having a polymeric encapsulation extending thereover, said polymeric encapsulation defining a trumpet extending outwardly of said anchor body in axial alignment with said cavity, said trumpet having a seal extending around an interior thereof so as to be in liquid-tight sealing relation with said sheathed portion of said tendon.

2. The apparatus of claim 1, said wedge member having a first portion and a second portion, said first portion being of a generally constant thickness and having an end adjacent said pair of wedges, said second portion having a first end and a second end, said second portion being of a decreasing thickness from said first end to said second end.

3. The apparatus of claim 2, said wedge member having an interior surface, said interior surface being in compressive contact with said tendon.

4. The apparatus of claim 2, said first portion having said interior surface in generally parallel relation to said exterior surface thereof.

5. The apparatus of claim 1, the engagement of said wedge member with said sheathing of said sheathed portion being suitable for retaining said sheathing against up to 150 pounds of pulling force.

6. The apparatus of claim 1, said sheathed portion extending into said cavity of said anchor body, said wedge member being positioned in said cavity.

7. The apparatus of claim 1, said wedge member having a generally circular cross-section.

* * * * *